US009925453B1

(12) United States Patent
Tuli

(10) Patent No.: US 9,925,453 B1
(45) Date of Patent: Mar. 27, 2018

(54) MOTORIZED WALKING SHOES

(71) Applicant: Raja Singh Tuli, Montreal (CA)

(72) Inventor: Raja Singh Tuli, Montreal (CA)

( * ) Notice: Subject to any disclaimer, the term of this patent is extended or adjusted under 35 U.S.C. 154(b) by 0 days.

(21) Appl. No.: 15/353,813

(22) Filed: Nov. 17, 2016

(51) Int. Cl.

| | |
|---|---|
| ***A43B 3/00*** | (2006.01) |
| ***A63C 17/10*** | (2006.01) |
| ***A43B 13/14*** | (2006.01) |
| ***A63C 17/12*** | (2006.01) |

(52) U.S. Cl.
CPC ..... *A63C 17/10* (2013.01); *A43B 3/0005* (2013.01); *A43B 13/141* (2013.01); *A63C 17/12* (2013.01)

(58) Field of Classification Search
CPC ..... A43B 3/0005; A43B 13/141; A63C 17/02; A63C 17/10; A63C 17/12
See application file for complete search history.

(56) References Cited

U.S. PATENT DOCUMENTS

| | | | | | |
|---|---|---|---|---|---|
| 3,876,032 | A | | 4/1975 | Ferino | |
| 4,508,187 | A | | 4/1985 | Wenzel | |
| 5,390,958 | A | * | 2/1995 | Soo | A63C 17/10 280/11.27 |
| 5,413,380 | A | * | 5/1995 | Fernandez | A63C 17/10 280/11.19 |
| 5,580,096 | A | * | 12/1996 | Freilich | A63C 17/10 280/844 |
| 5,730,241 | A | * | 3/1998 | Shyr | A63C 17/10 180/181 |
| 5,934,706 | A | * | 8/1999 | Yiu | A63C 17/10 280/11.26 |
| 6,059,062 | A | * | 5/2000 | Staelin | A63C 17/12 180/181 |
| 6,428,050 | B1 | * | 8/2002 | Brandley | A63C 17/12 280/11.19 |
| 7,383,908 | B2 | | 6/2008 | Tuli | |
| 8,668,039 | B2 | | 3/2014 | Tuli | |
| 9,027,690 | B2 | | 5/2015 | Chavand | |
| 9,295,302 | B1 | * | 3/2016 | Reed | A43B 7/14 |
| 9,526,977 | B2 | * | 12/2016 | Edney | A63C 17/12 |
| 2009/0101427 | A1 | * | 4/2009 | Baldwin | A63C 17/01 180/181 |
| 2011/0059664 | A1 | | 3/2011 | Poichot | |

* cited by examiner

*Primary Examiner* — Erez Gurari

(57) ABSTRACT

A motorized personal transportation article is provided to transport a person by wearing a pair of power-assisted motorized shoes, used in a normal forward walking action that provides a supplementary walking speed adjusted based on a user intended walking speed, even the intended speed changes during a mid-step. The sole of each of the shoes houses a relatively stiff plate coupled with conveyor assemblies in the toe and heel sections, respectively, which are connected by a relatively flexible portion. The assembly is designed to neutralize forces acting to disrupt its operation during walking while the flexible portion assists in bending the shoe naturally to maintain the natural walking balance and movement. Further, the flexible portion may equip with ribs or hinges for easier bending than twisting. The front and rear relatively stiff plates may make of twistable and bendable materials but to a lesser extent than the flexible portion.

34 Claims, 8 Drawing Sheets

MOTORIZED WALKING SHOES

CROSS-REFERENCE TO RELATED APPLICATIONS

This application is related to the following U.S. patent applications and patents: U.S. provisional application Ser. No. 12/120,204 filed on May 13, 2008; now U.S. Pat. No. 8,668,039, which is a continuation of U.S. provisional application Ser. No. 10/688,813 filed on Oct. 20, 2003, now U.S. Pat. No. 7,383,908. All of the patents and patent application mentioned in this paragraph are hereby incorporated by reference in its entirety.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND

Field of the Invention

The present invention relates to motorized personal transport means, more specifically, a field of power-assisted footwear to transport a user.

Description of Related Art

Power-assisted footwear enabling travel or motion of a user has been known as a means of personal transportation devices and generally limited to a concept of powered or motorized roller skates and in-line skates that involve skating motion. Examples of such efforts in the field are U.S. Pat. No. 3,876,032, U.S. Pat. No. 4,508,187, U.S. Pat. No. 5,236,058, U.S. Pat. No. 5,797,466 and U.S. Pat. No. 6,059,062. All these efforts represent a user's motion wherein the natural walking movement has little contribution, if not yet rendered useless, to the motion of the user with the power-assisted footwear in a working mode. In addition, in most of the prior efforts, the user of the power-assisted footwear has limited control on the speed of the footwear. Contrary to such power-assisted footwear that are designed to especially avoiding natural walking movements and targeted on a sportier motion, the present invention is designed to supplement the natural walking movement by providing a range bound, user selected increment to the normal walking speed which is always in response to the user's walking intention.

U.S. Pat. No. 9,027,690 by Dijon describes and claims another type of power-assisted footwear. This teaching utilizes a hinge system which pivots the mechanical belt when the foot bend during walking. While this device is useful as a personal transport means, it is dissimilar to the invention described herein, and lacks certain features and functional benefits that will become apparent to those skilled in the art by reading the detailed description accompanying with the drawings and the claims below.

The present invention is designed to be user friendly and to have an advantage of power-assisted motion in addition to normal walking motion such that a user walks at a faster speed than normal walking without altering the stability or the movements of a normal forward walking action.

BRIEF SUMMARY OF THE INVENTION

The invention described herein depicts an article of motorized personal transportation means that transports a person by wearing a pair of power-assisted motorized shoes. It is more particularly, that the present invention be used in conjunction with a normal forward walking action by providing a range bounded, user selected speed increment to a normal walking speed of a person while maintaining the normal walking movement and balance. According to an aspect of the present invention, when the soles of the motorized walking shoes are in contact with an underlying surface, the step length and the walking speed increase in accordance with the user real-time walking intention. In a further aspect, the present invention does not disturb the natural walking balance or affect the utility and comfort of a pair of walking shoes.

The present embodiments relate generally to articles of footwear that include motorized and adjustable systems. In a principal embodiment, the sole of the shoe, from a pair of shoes, houses power storage, sensory devices and computer. In each of the soles, a stiff plate is installed under the toe and the heel sections, respectively. The two stiff plates are connected by a flexible portion located under a crumple zone, in which the shoe bends during a forward walking action. Two conveyor assemblies are coupled on each stiff plate, in which each of the conveyor assemblies comprise a conveyor belt, wrapped over and clasping at least a set of wheels or rollers. At least a pair of the wheels or rollers between the two conveyor assemblies that located on the same stiff plate is connected to a motor to drive the conveyor assemblies forward. The speed of the motor, which in turn controls the speed of the conveyor assemblies, is always in response to the user's walking intention and the user's original walking speed in real time. The walking intention and the original walking speed of a user is deduced by the computer on board based upon the geographic information or speed data received from the sensors embedded in the shoe sole or based upon the body movement detected from sensors attached to the user's body. When a change of user's intended walking speed is sensed during a mid-step, the computer on board synchronously adjust the speed of all the conveyors in both of the shoe sole such that a new intended walking speed is reached within a step. Further, the computer on one sole communicates wirelessly with the computer on the other sole to maintain synchronized speed and motion of the conveyor assemblies between the two soles. In addition, the computers control all electrical and mechanical operations of the present invention. In another embodiment, all electrical and mechanical operations are handled remotely.

In accordance to the present invention, the conveyor assemblies have mechanisms to handle any external forces that generated during impact of the sole with an underlying surface. The conveyor assemblies are designed to operate continuously without any disruption despite such intermittence external forces that may be in favour or opposite to the motion of the conveyor assemblies.

In another embodiment, the flexible portion is a flexible portion equipped with ribs such that it has a greater extent of bending than twisting. In another embodiment, the flexible portion is equipped with at least a hinge that runs across the center of the plate.

In another embodiment, a plurality of wheels or rollers is distributed along the belt conveyor, in which the wheels or rollers are equally spaced or not, in active power driven or passive power driven. Further, additional supporting shafts and gears may be incorporated into the relatively stiff plate in order to have a more rigid structure or an effective setup.

In another embodiment, the front and/or rear relatively stiff plates are made with flexible materials that allow a certain degree of bending and twisting, yet to a lesser extent than the flexible portion. Further, the front and the rear relatively stiff plates can be made of different or the same material as long as each individual stiff plate is bendable and twistable, yet to a lesser extent than the flexible portion.

In another embodiment, the multiple wheels or rollers conveyor assemblies are tilted upward with a fixed angle in the front section if these are coupled under the toe section or tilted upward with a fixed angle in the rear section if these are coupled under the heel section.

In another embodiment, multiple wheel or rollers conveyor assemblies are coupled on the relatively stiff plates that are made of flexible material, while the flexible portion has multiple hinges distributed along the length of the flexible portion.

In another embodiment, the conveyor assemblies in the front relatively stiff plate may have different length and/or width than those in the rear plate as long as the conveyor assemblies in each stiff plate are identical and parallel to each other. Further, the shape of the relatively stiff plate may be different from each other in another embodiment.

In another embodiment, there is at least a spring and shock absorber distributed along the length of the front conveyors assemblies and/or rear conveyors assemblies that connect the relatively stiff plate with the set of rollers or wheels clasped over by the conveyor belt.

A combination of material choice and shape of the front and rear relatively stiff plates, and of the flexible portion, would provide other alternative embodiments, which are conceivable to one of ordinary skill in the art. In addition, other aspects, features, utilities and advantages of the invention will become apparent from the following detailed description and drawings, and from the claims.

BRIEF DESCRIPTION OF THE DRAWINGS

The various preferred embodiments of the present invention described herein can be better understood by those skilled in the art when the following detailed description is read with reference to the accompanying drawings. The components in the figures are not necessarily drawn to scale and any reference numeral identifying an element in one drawing will represent the same element throughout the drawings. The figures of the drawing are briefly described as follows.

DETAILED DESCRIPTION OF THE INVENTION

The present invention related to a concept of motorized personal transportation means, more particularly, to a pair of power-assisted motorized shoes with referenced to U.S. provisional application Ser. No. 12/120,204 filed on May 13, 2008; now U.S. Pat. No. 8,668,039, which is a continuation of U.S. provisional application Ser. No. 10/688,813, filed on Oct. 20, 2003, now U.S. Pat. No. 7,383,908. The invention described herein is designed to work in conjunction with a normal forward walking action. The pair of shoes has identical devices constructed in their soles such that when the soles are in contact with an underlying surface during a course of a normal walking action, it translates the user to a distance farther than without wearing it. In the present invention, the step length and the walking speed increase without altering a normal walking action or disturbing the natural walking balance.

Figure 1:
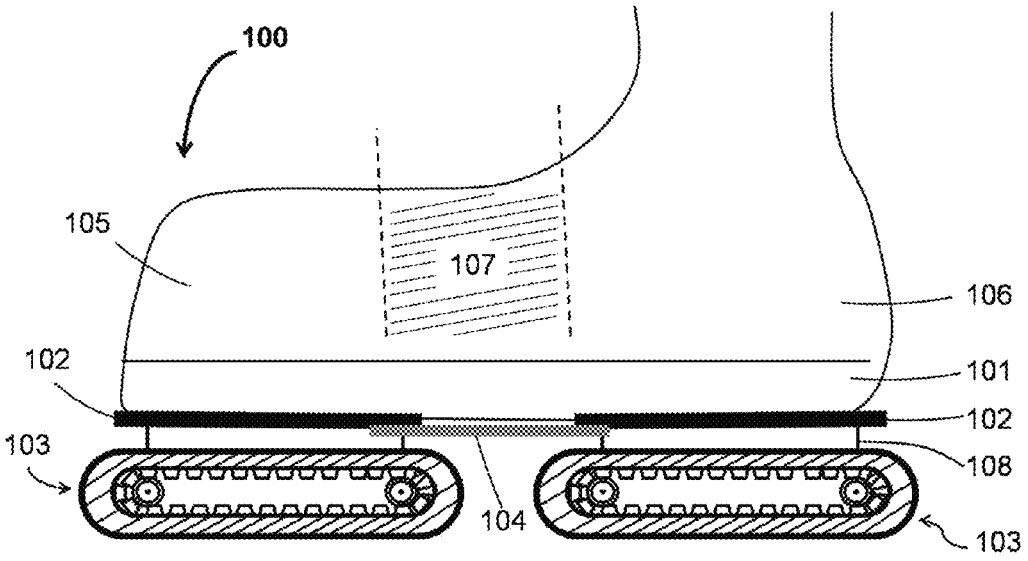
FIG. 1 illustrates a side view of a shoe of the present invention in a principal embodiment.

In a principal embodiment of the invention, with reference to FIG. 1, sole 101 of a shoe 100, from a pair of shoes, comprising a flexible portion 104 and two relatively stiff plates 102, wherein each of the relatively stiff plates 102 houses at least one conveyor assembly 103. A mechanical means 108 such as a hinge connects the conveyor assembly 103 to the relatively stiff plate 102. The relatively stiff plates 102, ideally made of metal such as aluminum, are positioned on the toe area 105 and the heel area 106 of the shoe 100 while the flexible portion 104, which is preferably a plate made of plastic such as nylon that connects the two relatively stiff plates 102 together. As being twistable and bendable, the flexible portion 104 is installed under a crumple zone 107, which is an area of the shoe 100 that bends along with the foot in a forward walking action. Power storage, sensory devices and computers are located in the sole 101 of each of the two shoes 100 to ensure a synchronized speed and motion of the conveyors assemblies 103. The computers are in wireless communication with each other and with the sensors in the sole 101, respectively.

In the principal embodiment, the flexible portion 104 is designed to be twistable and bendable since a shoe needs to be bent along with the foot during walking. The flexible portion 104 facilitates bending the shoe 100 naturally in the crumple zone 107 during a normal walking motion such that it maintains the comfort of a natural walking action without affecting the utility as a pair of walking shoes. Since the contact angle between the foot and the underlying ground in a forward walking motion would vary from step to step due to a number of factors, such as the profile of a terrain, the need to manoeuvre and the walking speed of the user, the flexible portion 104 is made to withstand recurrent bending and twisting of various extents such that it reverts to its original shape once the applied torque due to the impact with the underlying surface has been eliminated. Furthermore, no conveyor assembly 103 needs to be bent within the crumple zone 107 when the shoe 100 bends as this may distort the motion and the balance of the conveyor assemblies 103. Therefore, the present invention preserves the user's natural walking action and the balance of the forward walking action when the conveyors assemblies 103 are the only contact with the underlying surface.

Figure 2:
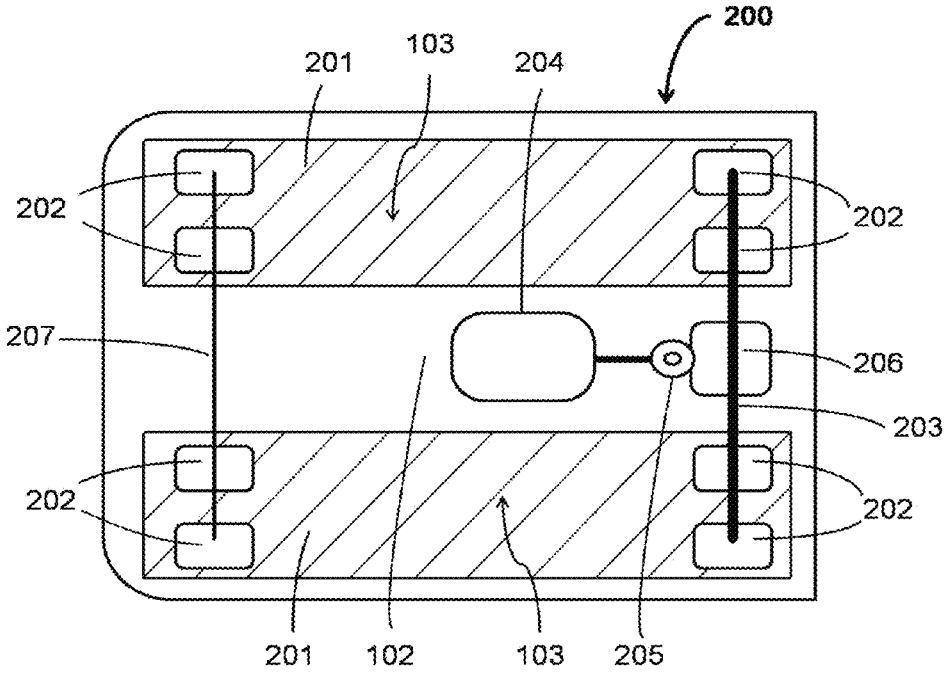
FIG. 2 illustrates a top view of a relatively stiff plate with conveyor assemblies in the principal embodiment.

In the same principal embodiment, referring now to FIG. 2, the conveyor assembly 103 comprises a belt conveyor 201, advantageously notched, wrapped over and clasping at least a set of wheels or rollers 202, wherein the sets of wheel or rollers 202 are located near the front and rear ends of the belt conveyor 201. It is preferable that the belt conveyor 201 be made of a thick layer of soft rubber such that it acts as a cushion to absorb some of the impacts of the foot during a normal walking action. Two identical conveyor assemblies 103 are coupled on the stiff plate 102, in which each of these is installed along a direction from the toe section 105 to the heel section 106 of the shoe 100 and is positioned parallel to each other to provide a lateral stability of the shoe 100. At least a pair of the wheels or rollers 202 between the two conveyor assemblies 103 is connected to a rotary shaft 203 of a worm gear mechanism, which is powered by a motor 204. The worm gear mechanism, comprises a worm 205 and a worm wheel 206, is configured to be installed on the motor 204 to drive the wheels or rollers 202 such that it imparts rotation to the belt conveyors 201 and, subsequently, transports the foot forward. All conveyors assemblies 103 housed in a stiff plate 102 have the same speed that is synchronized by the computer on board. The computers, housed in the sole 101 of each of the two shoes 100, communicate constantly with each other by wireless means so that the speed of the conveyor assemblies 103 is synchronized and is the same between the two shoes 100.

Figure 3:
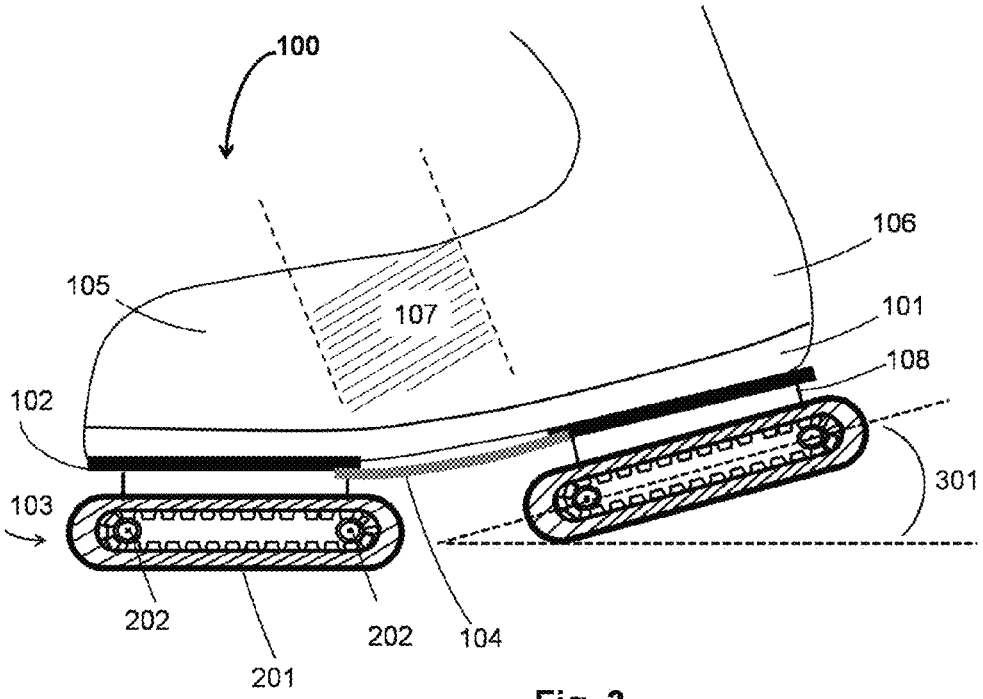
FIG. 3 illustrates a side view of a shoe in the principal embodiment that the conveyor assemblies in the rear relatively stiff plate start breaking contact with an underlying surface as the heel lifted up in a forward walking action.

Now referring to FIG. 3 wherein it illustrates the shoe 100 starts breaking contact with the underlying surface, i.e. when one start lifting up the foot from the underlying surface in a forward stepping motion with an incline angle 301 relative to the underlying surface in the heel section 106. Due to the angular upward motion of the foot, an assistance force as a combination of an upward force and an angular force in favour to the movement of the conveyor assemblies 103 is generated. This assistance force being exerted on the conveyor assemblies 103 may increase the speed of the conveyors assemblies 103 or may cause belt slip if it is sufficiently large. Accordingly, the conveyor assemblies 103 have a mechanism to keep moving at the preset speed synchronously despite this assistance force.

Similarly, due to an angular downward stride of the foot in a forward walking action, a force opposing the forward movement of the conveyors 201 is generated when the heel section 106 first in contact with the underlying surface. Such resistance force, which is a combination of an angular force and a downward force exerted on the conveyor assemblies 103, resist the ongoing speed of the motor 204 and may cause backlash on the belt conveyor 201, stalling its motion or changing its speed suddenly when the force is sufficiently large. Therefore, anti-backlash mechanism that is capable of preventing loss motion and impeding uncontrolled reverse movement of the conveyor assemblies 103 is equipped in the system. Anti-backlash mechanism, such as anti-backlash worm gears with the axis of rotation of the worm 205 and the worm wheel 206 positioned at a specific angle may be implemented into the system. The anti-backlash mechanism can ensure the conveyor assemblies 103 continuously and synchronously moving at the preset speed without being disturbed at some instances when there are shocks caused by this resistance force.

Again, in a normal forward walking action, the amount of the contact area between the sole and the underlying surface is continuously changing in a gait cycle, therefore, the assistance force exerted on the toe section 105 and the opposing force exerted on the heel section 106 are not constant, yet are continuously changing in magnitude over time. Accordingly, the mechanisms of the conveyor assemblies 103, which may be aided by sensory devices and computer controlled actions, are capable to compensate the irregular external forces in order to keep the conveyor assemblies 103 moving at the preset speed synchronously.

Figure 4:
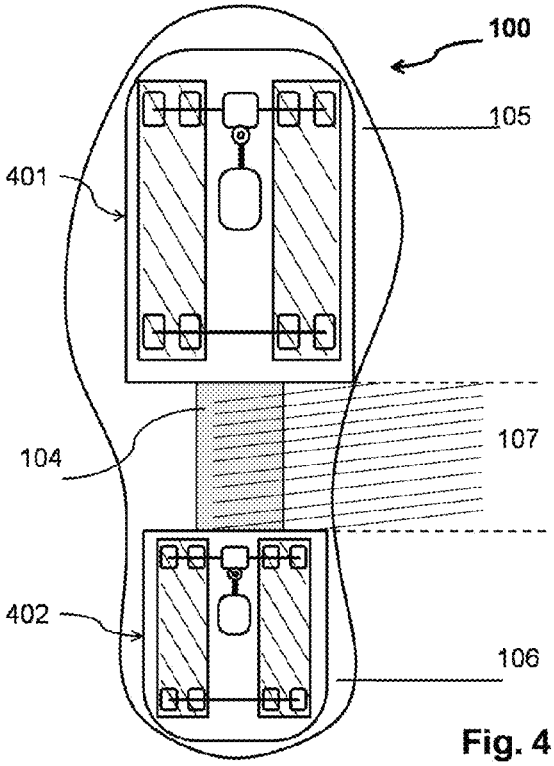
FIG. 4 illustrates a plan view of a sole in the principal embodiment having two relatively stiff plates connected by a flexible portion.

In another aspect of the present invention, as illustrated in FIG. 4, the arrangement of having two relatively stiff plates with conveyor assemblies 401 and 402 connected by a flexible portion 104 in the principal embodiment helps to minimize the effect of the assistance force exerted on the rear relatively stiff plate 402 since the rear relatively stiff plate 402 breaks contact from the underlying surface as soon as the heel section 106 is lifted up and the flexible portion 104 also assists in bending the shoe 100 at the crumple zone 107 with the foot motion. Similarly, the conveyor assemblies 103 on the front relatively stiff plate 401 located near the toe area 105 is less affected by the resistance force when the foot strikes down in an angular motion as its contact time with the underlying surface is minimized.

While in a forward walking stride, the motorized shoe 100 contributes an additional step length to the user, which subsequently increases the walking speed by a preset percentage. For safety reasons and for having an augmented user experience while the motorized walking shoes 100 are in working mode, it is essential to keep track of the user's walking speed and to identify the user intention such that the conveyors' speed is adjusted at any instant in accordance with the user intention. In the principal embodiment, therefore, sensory devices such as accelerometer, IR camera, IR sensor, GPS tracking system, other means in the art or a combination thereof, are located in the sole 101 of at least one shoe 100 to track the geographical information and, subsequently, the speed of the user. More precisely, it is to obtain a real-time walking speed of the user when the motorized walking shoes 100 are in working mode.

In a general case, based on the information received from the sensors, the intention of the user's walking action, such as speeding up or slowing down the walking or stopping the action etc., is deduced by the computer in the sole 101. One of the indicators to help deducing the user intention is by knowing the user intended walking speed, i.e. an ordinary walking speed the user would possibly have if the walking action was not aided by the present invention. Accordingly, the conveyors' 103 speed is adjusted in real time such that the user's walking speed aided by the present invention is always conforming to the user intended walking speed. In all cases, the conveyors assemblies 103 housed on each shoe 100 are moving at the same speed and are synchronized in motion. This mechanism allows the computer on board to accelerate, decelerate, stopping or maintaining a constant speed of all conveyors 103 synchronously in response to the user walking speed measured by the sensors. In all of the above embodiments and subsequent, the computer embedded on each sole 101 operates all the electrical and mechanical operations related to the conveyor assemblies 103.

In accordance with the present invention, if the user while walking is gradually coming to a stop, then in response to the information from the sensors, the computer housed in each sole 101 of the pair of shoe 100, which communicates wirelessly with each other and with the sensors, deduces the intention of the user and, subsequently, gradually reduces the speed of all conveyors assemblies 103 to zero synchronously. Mathematically speaking, the sensors measure the walking speed of the user with the aid of the motorized shoes 100 $S_s$, which is equal to the ordinary walking speed contributed by the user $S_u$ plus the translation speed contributed by the conveyor assemblies 103 $S_c$ such that $S_s=S_u+S_c$. $S_c$ is governed by a preset parameter X that is defined as a percentage increase of the user ordinary walking speed $S_u$ such that $S_c=S_uX$. The walking speed of the user aided by the motorized shoes $S_s$ then becomes $S_s=S_u+S_uX$.

In an exemplary implementation, assuming the preset parameter X of the speed increment is 50% and the ordinary walking speed of the user is $S_u=6$ km/hr at time $t_0$, then the conveyor assemblies 103 of each of the two shoes 100 are moving at $S_c=3$ km/hr and the user walking speed aided by the present invention is $S_s=9$ km/hr at $t_0$, as measured by the sensors.

If the user intended to walk at a faster speed at a later time $t_1$, for example, from $S_u=6$ km/hr at $t_0$ increases to $S_u=10$ km/hr at $t_1$, an increase of speed is detected by the sensors and subsequently, the speed of all the conveyors 103 in both shoes 100 increases synchronously from $S_c=3$ km/hr at $t_0$ to $S_c=5$ km/hr at $t_1$. The user walking speed aided by the present invention at $t_1$ is $S_s=15$ km/hr, as measured by the sensors.

Similarly, if the user is gradually slowing down and comes to a complete stop at a later time $t_2$, i.e. from $S_u=10$ km/hr at $t_1$ gradually decreases to $S_u=0$ km/hr at $t_2$, the sensors sense the gradual decrease of speed over the course of time $t_1$ to $t_2$ and eventually sense a stationary motion of the user at $t_2$. Accordingly, the speed of all the conveyors 103 in both shoes 100 decreases gradually and synchronously from $S_c=5$ km/hr to $S_c=0$ km/hr over the course of time $t_1$ to $t_2$ such that the user's walking motion is stopped with $S_s=0$ km/hr at $t_2$.

In a further embodiment, the preset percentage parameter X is adjustable electronically and/or remotely by the user. Further, any preset parameters of the conveyor assemblies 103 can be reset and synchronized by an electronic remote operation and the conveyor assemblies 103 can be switched on and off via a remote switch.

In a mid-step of a walking gait cycle, one of the user's feet is placed on the ground while the other one is lifted up in the air. In situation when a user changes the walking intention during the mid-step and intends to reach the new speed within one step, the foot on the ground cannot tell the intended speed difference because that foot is moving at a speed inherited from the user's motion before the change of intention. For example, the user ordinary walking speed is $S_u=1$ km/hr and the conveyor translation speed is $S_c=0.5$ km/hr when the preset parameter X=50%, then the foot on the ground is moving at a speed of $S_s=1.5$ km/hr. However, the foot that is lifted up in the air shows a different speed $S_u$ since the user changes the walking intention. Therefore, it is essential to measure the instantaneous speed of the foot that is lifted up in the air by the sensors embedded in that sole 101, such that the motion between the two shoes 100 is synchronized and is instantaneously in response to a change of speed that needs to be satisfied within a step.

Figure 5:
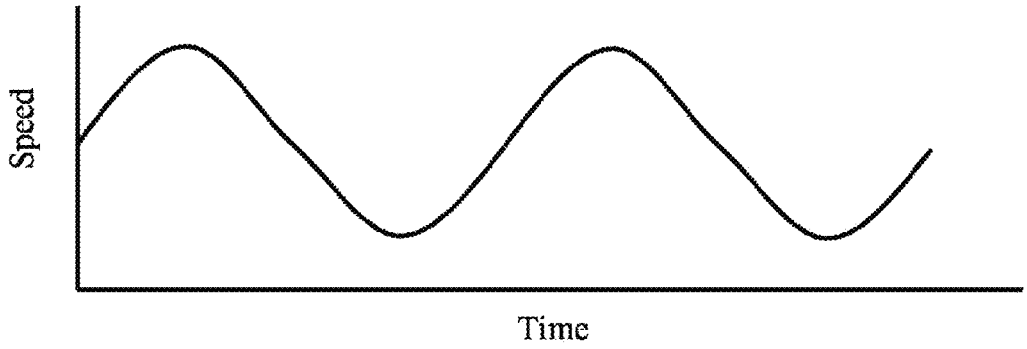
FIG. 5 illustrates a general curve of speed versus time in one normal forward walking gait cycle.

In a normal forward walking gait cycle, the speed of the feet in one gait cycle has a general shape as illustrated in FIG. 5, suggesting also that the feet subject to acceleration or deceleration or a transition thereof depending on the various stages in the gait cycle. Based on this pattern, the instantaneous speed of the foot is predictable if there is no sudden change of speed. When the sensors detect an instantaneous speed of the lifted foot that is substantially different from the predicted speed in the curve, e.g. a speed close to zero as the user intended to stop the walking motion in the remaining half step while the predicted speed is 0.6 km/hr at that instant, then the computers on the sole 101 of each of the two shoes 100, communicating wirelessly with each other and with the sensors, will synchronously slow down the speed of the conveyor assemblies 103 on both shoes 100 to a complete stop by the time the lifted foot landed on the ground to complete the step. Therefore, the motion and speed of the conveyor assemblies 103 in both shoes 100 are synchronized.

In a further embodiment, sensory devices attached to the upper part of the user's body are used to deduce a change of the user intention that happened during a mid-step with very short response time, e.g. a new speed that needs to be reached within a step. The sensors measure the speed of the user relative to the ground or sense the body motion of the user. For example, a certain backward incline angle of the upper body or suddenly a very slow moving speed of the user may used as indicators to synchronously slowing down and stopping the conveyor assemblies 103 of both shoes 100 within a step.

Figure 6:
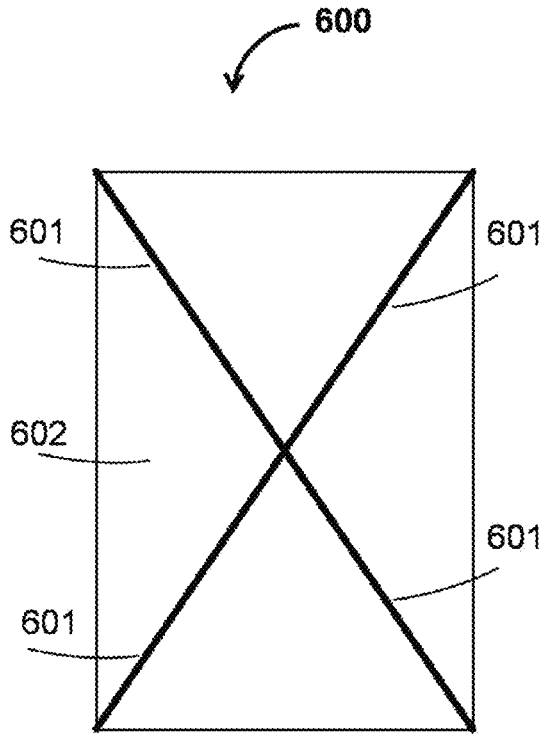
FIG. 6 illustrates a plan view of a flexible portion with ribs.

FIG. 6 depicts an alternative embodiment of a flexible portion equipped with ribs 600 such that it remains bendable and twistable, yet to a different extent such that the flexible portion 600 is much easier to bend than to twist. The ribs 601 are made from the same or a different material than the flexible matrix 602, being molded, welded or embedded into the flexible matrix 602 to make twisting the piece more difficult than bending it. By example and not by way of limitation, the ribs 601 are extended from the corners and merged at the center of the piece but other arrangements of the ribs 601 are also conceivable.

Figure 7A:
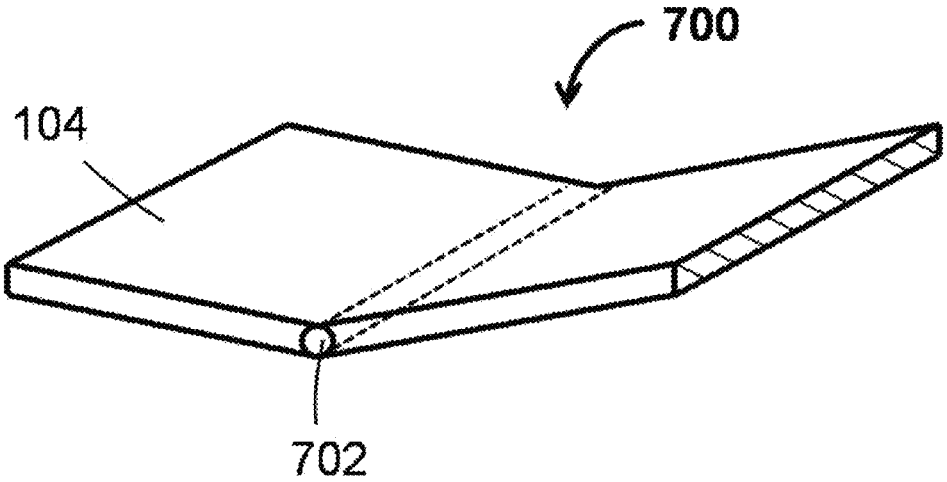
FIG. 7A illustrates a perspective view of a flexible portion with a hinge in center.
Figure 7B:
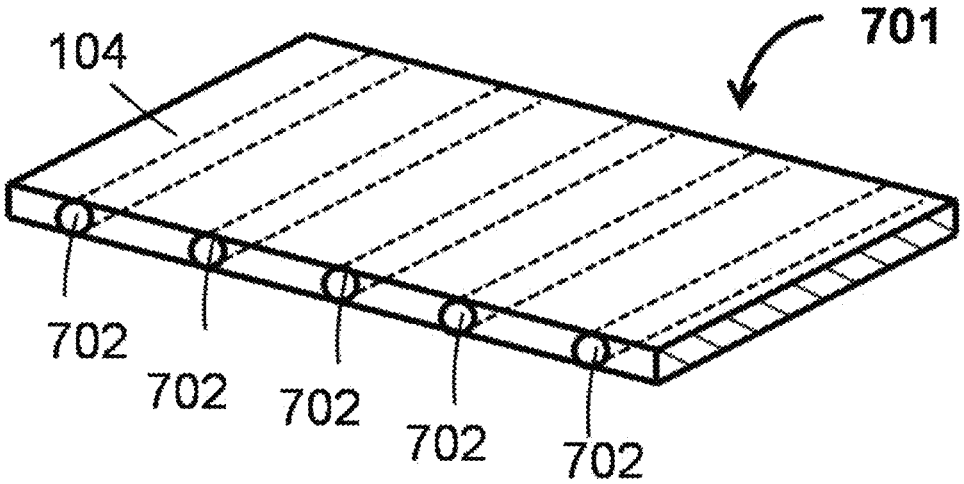
FIG. 7B illustrates a perspective view of a flexible portion with multiple hinges.

In another embodiment, as shown in FIG. 7A, a hinge 702 that runs across the center of the flexible portion 104 is incorporated such that the flexible portion 104 remains bendable and twistable, yet it is much easier to bend than to twist so that the shoe 100 bends naturally during walking. In a further embodiment as shown in FIG. 7B, there is a plurality of hinges 702 distributed along the length of the flexible portion 104 such that the flexible portion 104 has a even greater extent of bending than twisting.

Figure 8:
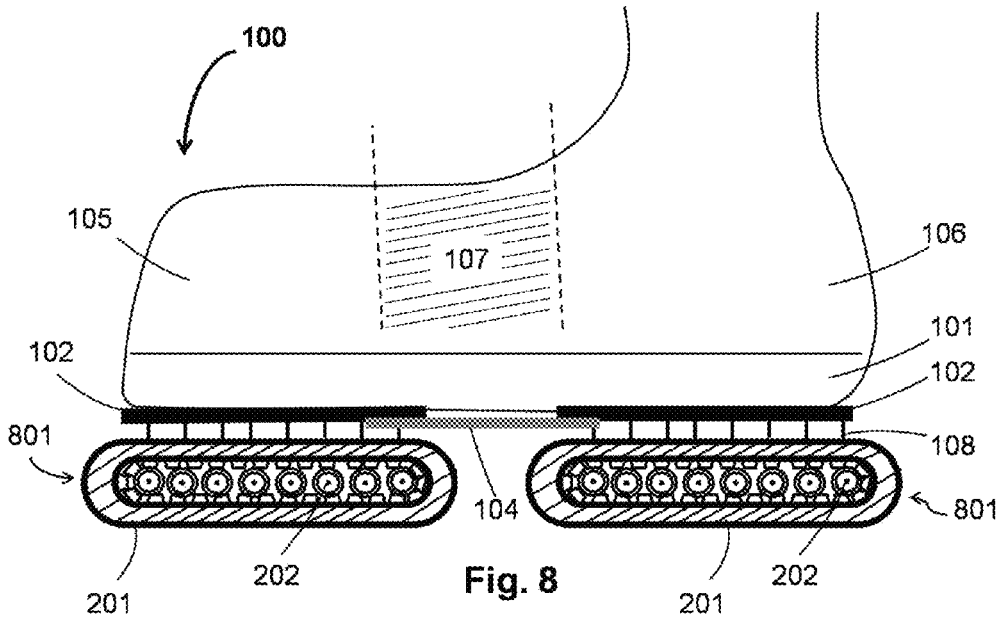
FIG. 8 illustrates a side view of a shoe with conveyor assemblies in multiple wheels or rollers coupled to the front and the rear relatively stiff plates.

In yet another embodiment of the present invention as depicted in FIG. 8, there are multiple pairs of wheels or rollers 202, equally spaced or not, distributed along the length of a belt conveyor 201 that is connected to the relatively stiff plate 102. The two conveyors assemblies 801 with multiple pairs of wheels or rollers 202 coupled to the relatively stiff plate 102 are always identical and parallel to each other. In order to have a more rigid structure or an effective setup, additional shaft 207 (in FIG. 2) and gears that connecting a plurality of wheels and rollers 202 may be incorporated into the setup but not necessary be power-assisted. The wheels or rollers 202 that are not directly connected to the motor 204 are passively driven by the motion of the belt conveyor 201 and in a sense that the speed and motion of all the conveyors assemblies 801 in each shoe 100 are the same and synchronized.

The operating principle of the present invention is that the conveyors assemblies 103 contribute an additional step length to the user on top of an ordinary step length that the user would possibly have in a usual gait cycle when the walking action is not aided by the present invention. Hence, once the shoe 100 is in contact with the underlying surface, the present invention transports that foot farther in a forward walking stride until the said contact is broken. Accordingly, maximum contact area of the conveyor assemblies with the underlying surface is desirable for the present invention because it governs the efficacy of the conveyors assemblies 103 in transporting the foot forward. In a forward walking action, the heel 106 of the shoe 100 initially strikes the underlying surface at a lateral angle. Accordingly, a particular area of the heel section 106 that aligns with this stride angle will have a greater contact area with the underlying surface than the other area of the heel section 106. Similarly, there is an angular contact at the toe area 105 when the user starts to lift the foot. By being twistable and bendable, the relatively stiff plates 102 bring the angle of the conveyor assemblies 103 on the front and the rear relatively stiff plates 401 and 402 closer to the contact angles of the toe 105 and the heel 106 sections with the underlying surface, respectively. The impact related twist and bend could occur in any direction depending on the profile of the terrain, the user stride angle and the stride force. Therefore, various extents of twisting and bending of the relatively stiff plate 102 are desirable to ensure the surface of the conveyors assemblies 103 remains closely parallel to the underlying surface in any circumstance.

Figure 9A:
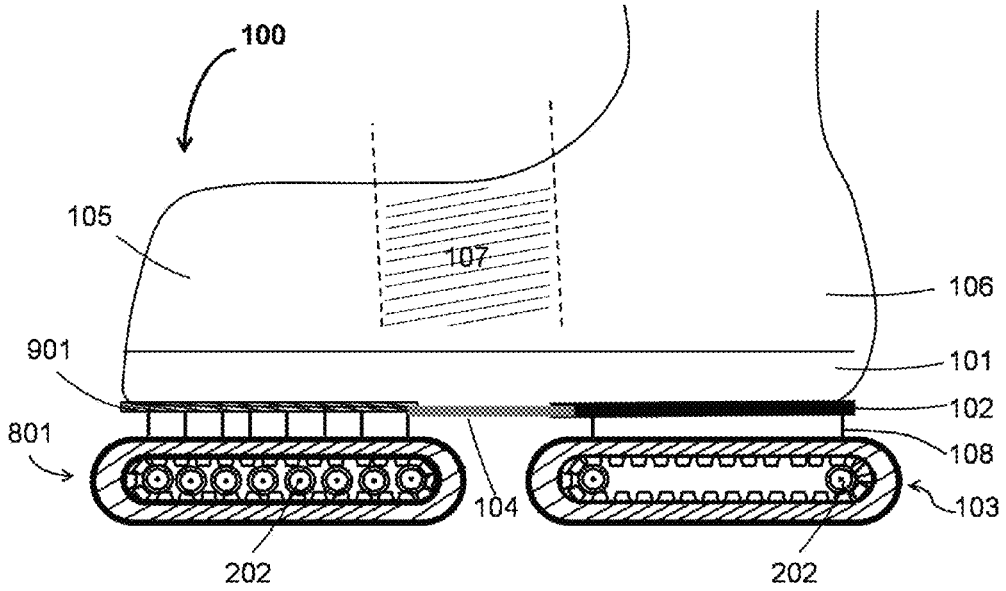
FIG. 9A illustrates a side view of a shoe with conveyor assemblies in multiple wheels or rollers coupled to a front relatively stiff plate that is made of flexible material.

Accordingly, in another embodiment as shown in FIG. 9A, the front relatively stiff plate 901 is made of flexible material so that it can be twisted and bent, whereas the conveyor assemblies 801 that coupled with have multiple wheels or rollers 202 so as to obtain a greater contact area between the conveyor assemblies 801 and the underlying surface when the toe area 105 is in angular contact with the underlying surface. The preferred material of the relatively stiff plate 901 is bendable and twistable but to a lesser extent than that of the flexible portion 104, such that this flexible stiff plate 901 remains a relatively stiff component compared to the flexible portion 104 in this embodiment.

Figure 9B:
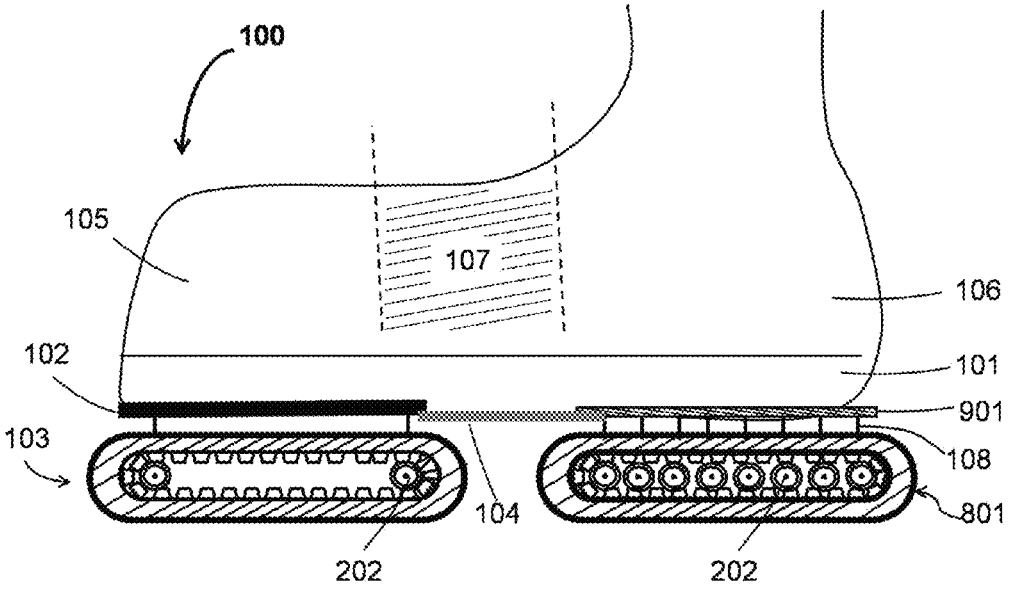
FIG. 9B illustrates a side view of a shoe with conveyor assemblies in multiple wheels or rollers coupled to a rear relatively stiff plate that is made of flexible material.

Similarly, in another embodiment as shown in FIG. 9B, the rear relatively stiff plate 901 is made of flexible material that can be bent and twisted but to a lesser extent than that of the flexible portion 104, and the conveyor assemblies 801 have multiple wheels or rollers 202 to further increase the contact area when the heel 106 is in angular contact with the underlying surface. The flexible stiff plate 901 is designed to remain as a relatively stiff component compared to the flexible portion 104. In a further embodiment, multiple wheels or rollers conveyor assemblies 801 are coupled to the front and the rear stiff plates 901 that are made of flexible materials in order to maximize the contact area between the conveyor assemblies 801 and the underlying surface during a forward walking action. The two flexible stiff plates 901 are made of the same flexible material that can be bent and twisted but to a lesser extent than that of the flexible portion 701 such that the flexible stiff plates 901 remain the relatively stiff components compared to the flexible portion 104.

Figure 10A:
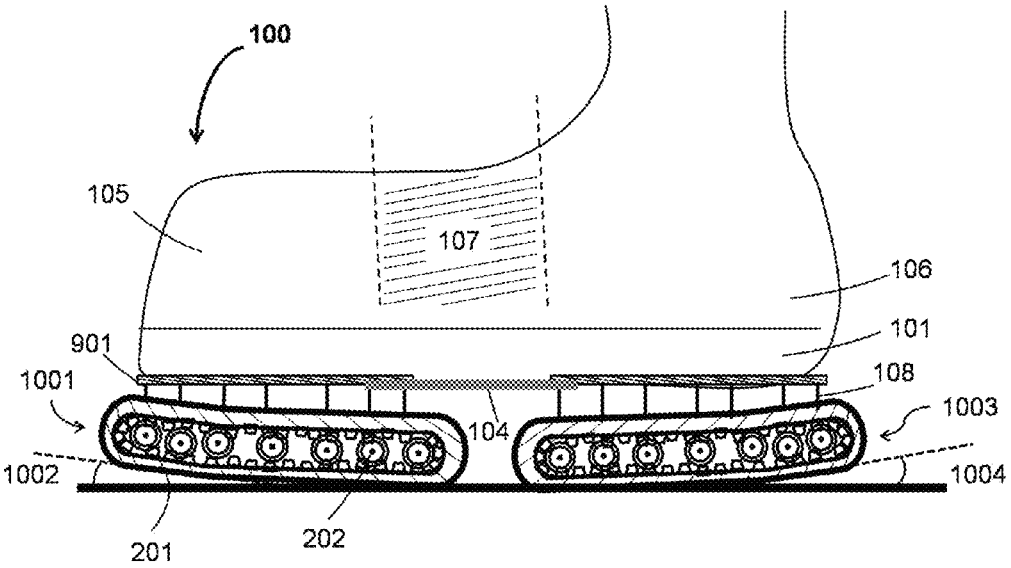
FIG. 10A illustrates a side view of a shoe with angled conveyor assemblies in multiple wheels or rollers coupled to the front and the rear relatively stiff plates that are made of flexible material.
Figure 10B:
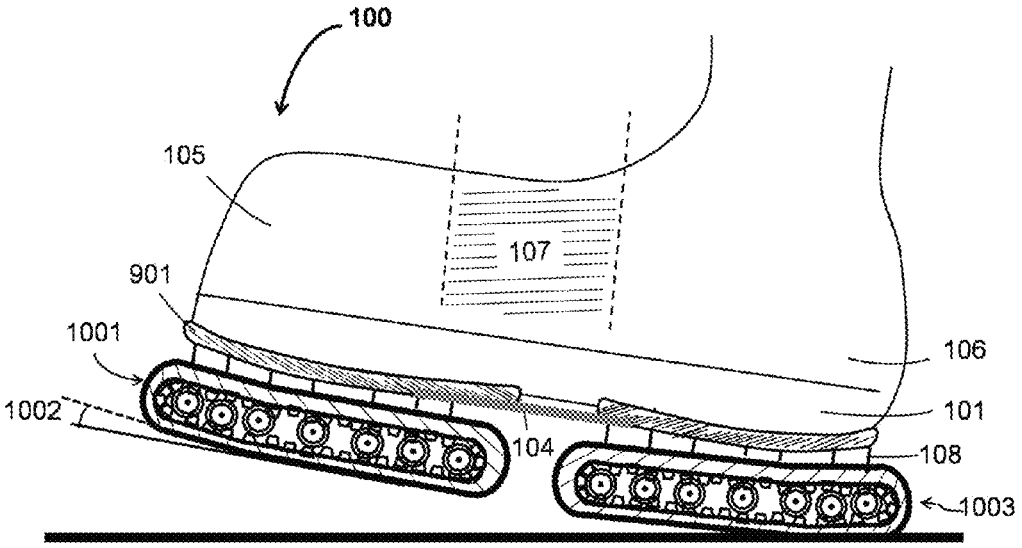
FIG. 10B illustrates a side view of a shoe with angled conveyor assemblies in multiple wheels or rollers coupled to the front and the rear relatively stiff plate that are made of flexible material, making a contact with underlying surface at the heel section as the foot is put down in walking forward.
Figure 10C:
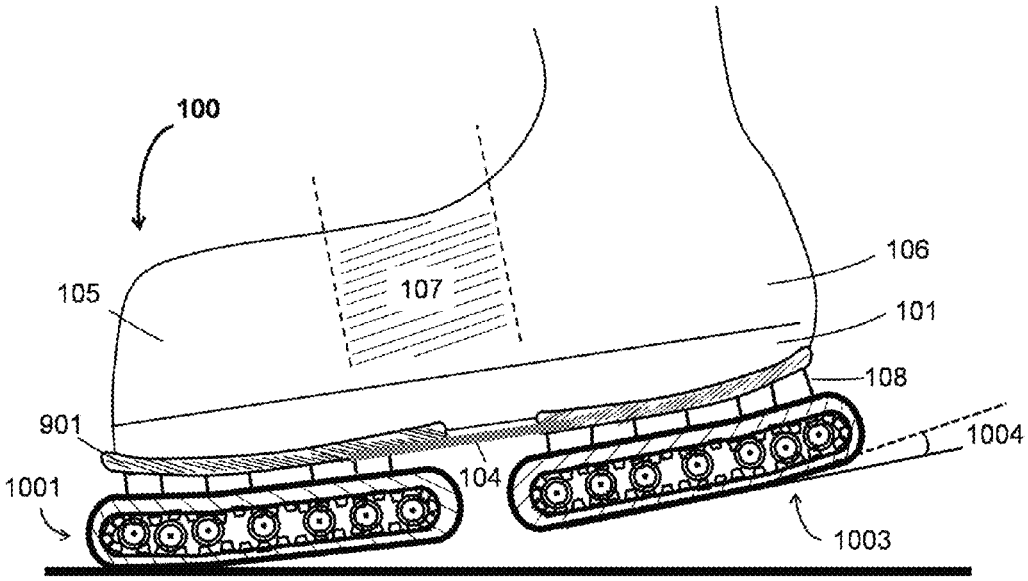
FIG. 10C illustrates a side view of a shoe with angled conveyor assemblies in multiple wheels or rollers coupled to the front and the rear relatively stiff plate that are made of flexible material, making a contact with underlying surface at the toe section as the foot is lifting up while walking forward.

In yet another embodiment as shown in FIG. 10A, an angled conveyor assemblies 1001 coupled under the toe 105 have the front sections tilted upward in an angle 1002 while another angled conveyor assemblies 1003 coupled under the heel 106 have the rear sections tilted upward in an angle 1004, such that the contact area between the conveyor assemblies 1001 and 1003 and the underlying surface can be maximized. The upward angles 1002 and 1004 are fixed, yet these angles 1002 and 1004 can be different from each other. To facilitate proper functioning of the angled conveyors assemblies 1001 and 1003, multiple pairs of wheels and rollers 202 are distributed along the conveyor belt 201 and both the front and the rear relatively stiff plates 901 are made of flexible materials. Since the conveyor belt 201 has a cushioned layer of thick rubber that helps to absorb some of the unevenness of the underlying surface and the impact during walking, a greater contact area between the conveyors assemblies 1003 and the underlying surface is obtained when the heel 106 of the shoe 100 hits the ground as shown in FIG. 10B. Similarly, a greater contact area between the conveyor assemblies 1001 and the underlying surface is obtained when the toe area 105 pushes the ground during walking as shown in FIG. 10C.

Figure 11:
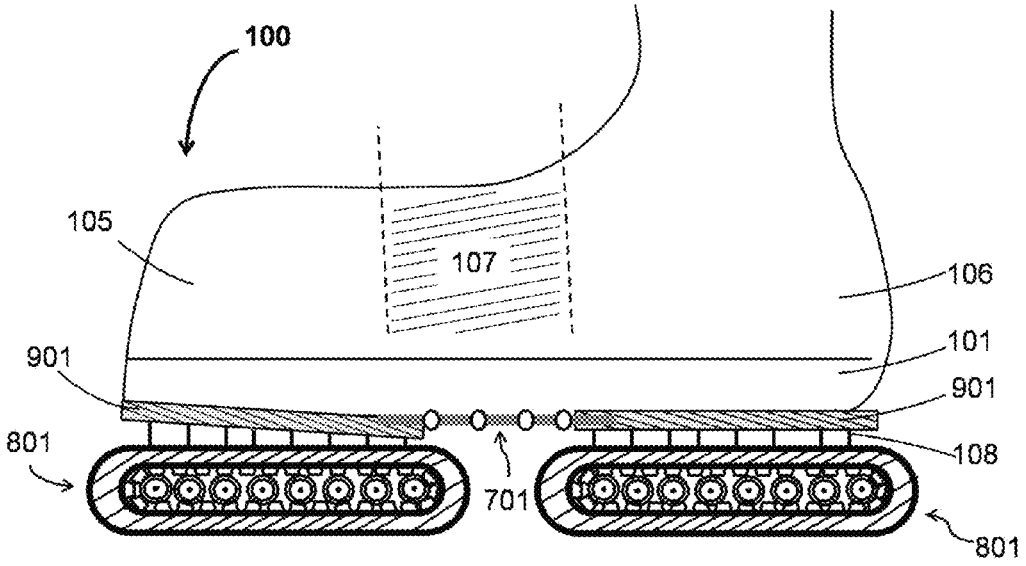
FIG. 11 illustrates a side view of a shoe with conveyor assemblies in multiple wheels or rollers coupled to the front and rear relatively stiff plates that are made of the same type of flexible material while the flexible portion has multiple hinges.

In a further embodiment as shown in FIG. 11, the multiple hinges flexible portion 701 and the multiples wheels or rollers conveyor assemblies 801 are coupled on the front and rear relatively stiff plates 901 that are made of flexible material, such that these relatively stiff plates 901 are bendable and twistable, yet to a lesser extent than that of the flexible portion 701. This embodiment assists in maximising the contact area between the conveyors assemblies 801 with the underlying surface while allowing the shoe 100 to bend naturally during walking.

Figure 12:
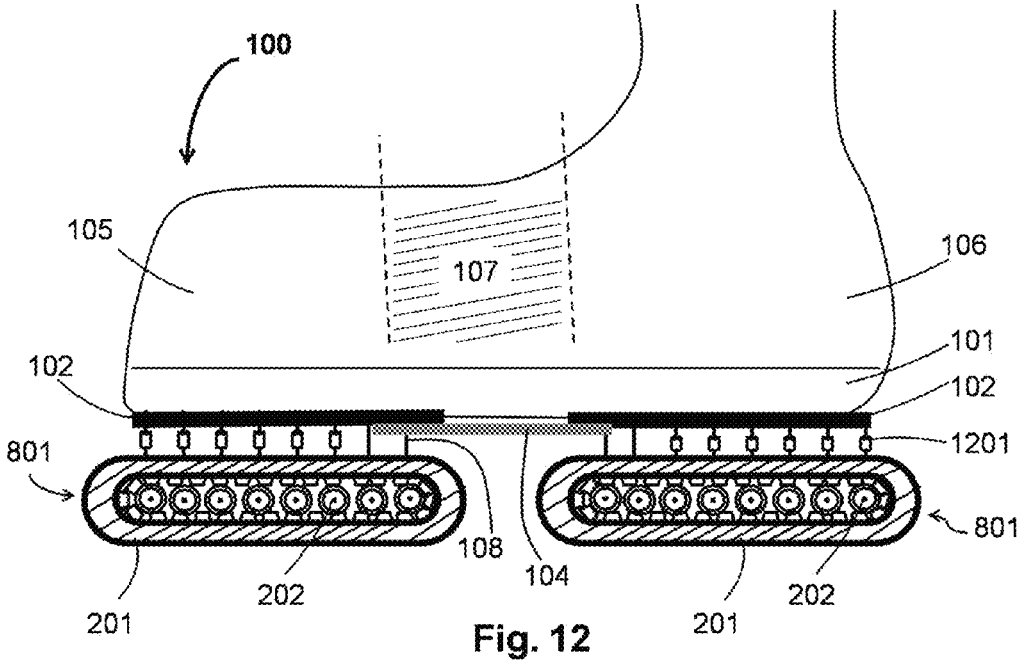
FIG. 12 illustrates a side view of a shoe with multiple springs and shock absorbers distributed along the conveyor assemblies.

In yet another embodiment, as depicted in FIG. 12, at least one of the mechanical means 108 that connecting the front and/or rear conveyor assemblies 103 to the relatively stiff plate 102 is replaced by a spring and shock absorber 1201. More precisely, the spring and shock absorber 1201 connects the set of rollers or wheels 202 of the conveyor assemblies 103 to the relatively stiff plate 102 so as to absorb some of the impacts of the foot during a normal walking action and to assist in maximizing the contact area between the conveyor assemblies 103 and the underlying surface. Other viscoelastic dampers or progressive shock dampers that associated with the conveyor assemblies 103 are also conceivable to those skilled in the art.

In a further embodiment, the front plate 401, rear plate 402 and the flexible portion 104 are all bendable and twistable, yet made of different materials and each having a different extent of bending and twisting. Again, the flexible portion 104 remains the most flexible component among the three.

In yet another embodiment, the conveyor assemblies 103 in the front relatively stiff plate 401 may have different or equal lengths, and/or width; to those in the rear relatively stiff plate 402 as long as the two conveyor assemblies 103 on a relatively stiff plate 102 are identical to each other to provide a balanced motion. The embodiment as depicted in FIG. 4 that having the conveyor assemblies in the rear relatively stiff plate 402 shorter than those in the front relatively stiff plate 401 is merely an example and should not be limited to other alternatives.

In all previous embodiments, the relatively stiff plate 102 is resilient that made to subject recurrent twisting and bending due to the impact with the underlying surface on the sole 101. Once the applied torque is eliminated with the forward movement of the foot, the twisted and bent relatively stiff plate 102 will revert to its original shape. Further, the relatively stiff plates 102 and the flexible portion 104 are illustrated as having a rectangle shape as depicted in FIG. 2 and FIG. 5, yet other geometric shapes such as square, arch and oval etc. are also possible depending on the shape of the sole 101.

In all previous embodiments, the conveyor assembly 103 is designed to operate continuously without any disruption while the attaching relatively stiff plate 102 bends and/or twists during a forward walking action. Further, the conveyor assembly 103 is made flexible to adjust to any impact related twist, which lasts for a very short period of time, and be quickly reverts to its original position without disrupting its operation once the pressure causing the twist drops in a forward movement of the foot.

DRAWING LEGEND

100. Shoe
101. Sole
102. Stiff plate
103. Conveyor assembly
104. Flexible portion
105. Toe section
106. Heel section
107. Crumple section
108. Mechanical means connecting the conveyor assembly to a stiff plate
200. Stiff plate with conveyor assemblies
201. Belt conveyor
202. Wheels or rollers
203. Rotary shaft
204. Motor
205. Worm
206. Worm wheel
207. Supporting shaft (optional)
301. Forward incline angle
401. Front stiff plate with conveyor assemblies
402. Rear stiff plate with conveyor assemblies
600. Reinforced flexible portion with ribs
601. Ribs
602. Flexible matrix
700. Flexible portion with hinge
701. Flexible portion with multiple hinges
702. Hinge
801. Conveyor assemblies with multiple pairs of wheels or rollers
901. Stiff plate in flexible material
1001. Angled conveyor assemblies with front sections tilted upward
1002. Upward tilted angle in the front sections of the conveyor assemblies
1003. Angled conveyor assemblies with rear sections tilted upward
1004. Upward tilted angle in the rear sections of the conveyor assemblies
1201. Spring and shock absorber

The invention claimed is:

1. A pair of powered motorized shoes to provide an increase in a user's walking speed by a translation motion while the user is walking, wherein the sole of each of the shoes comprises:

at least one conveyor coupled to a plate in a toe section;

at least one conveyor coupled to a plate in a heel section; and a flexible portion between the toe section and the heel section of each of the shoes, wherein the flexible portion connects plates of each of the shoes together to allow bending the shoes during a walking action.

2. A pair of powered motorized shoes as claimed in claim 1, wherein the sole of each of the shoes further comprises:

an electric power storage unit;

at least one motor coupled to the at least one conveyor that is coupled to a plate in a toe section of the sole and to the at least one conveyor that is coupled to a plate in a heel section of the sole to mechanically supply the translation motion to the at least one conveyor; and a processing unit coupled to the at least one motor, wherein the processing unit is in wireless communication with a processing unit of a paired shoe to synchronize speed between the paired shoes.

3. A pair of powered motorized shoes as claimed in claim 2, wherein mechanical means coupling the at least one motor with the at least one conveyor that is coupled to a plate in a toe section of the sole and to the at least one conveyor that is coupled to a plate in a heel section of the sole comprises an anti-backlash mechanism.

4. A pair of powered motorized shoes as claimed in claim 1, wherein each of the at least one conveyors further comprises at least one set of rollers or wheels wrapped over and clasped by a conveyor belt.

5. A pair of powered motorized shoes as claimed in claim 4, wherein the conveyor belt has an outer cushioned layer to absorb impacts during a walking action.

6. A pair of powered motorized shoes as claimed in claim 1, wherein the at least one conveyor is coupled to the plates in a toe section and in a heel section of the sole by mechanical means that comprise at least one shock absorber connecting at least one of the plates to at least one set of rollers or wheels wrapped over and clasped by a conveyor belt.

7. A pair of powered motorized shoes as claimed in claim 6, wherein the at least one shock absorber comprises at least one spring.

8. A pair of powered motorized shoes as claimed in claim 1, wherein the flexible portion is made of a twistable material, and the flexible portion is more flexible than the plates.

9. A pair of powered motorized shoes as claimed in claim 8, wherein at least one of the plates is made of a twistable material that is less twistable than the flexible portion.

10. A pair of powered motorized shoes as claimed in claim 1, wherein each of the plates is coupled to a set of at least two conveyors that move synchronously.

11. A pair of powered motorized shoes as claimed in claim 10, wherein the at least two conveyors that are coupled to a same plate are aligned substantially parallel to each other and oriented along a direction from the toe to the heel of the shoe.

12. A pair of powered motorized shoes as claimed in claim 1, wherein the at least one conveyor that is coupled to a plate in a toe section of the sole and the at least one conveyor that is coupled to a plate in a heel section of the sole comprise a mechanism that allows a continuous motion at a selected speed despite external forces exerted on the shoes during a walking action.

13. A pair of powered motorized shoes as claimed in claim 1, wherein the flexible portion comprises at least one rib.

14. A pair of powered motorized shoes as claimed in claim 1, wherein the flexible portion comprises at least one hinge that runs across the flexible portion.

15. A pair of powered motorized shoes as claimed in claim 1, wherein at least one of the plates is made of flexible materials, and the at the least one conveyor coupled to said at least one plate made of flexible materials comprises at least one set of wheels or rollers distributed along a direction from the toe to the heel of the shoe.

16. A pair of powered motorized shoes as claimed in claim 1, wherein each of the at least one conveyor coupled to a plate in the toe section is tilted upward in the front section of said at least one conveyor.

17. A pair of powered motorized shoes as claimed in claim 1, wherein each of the at least one conveyor coupled to a plate in the heel section is tilted upward in the rear section of said at least one conveyor.

18. A pair of powered motorized shoes as claimed in claim 1, wherein the mechanical operations related to the at least one conveyor that is coupled to a plate in a toe section of the sole and to the at least one conveyor that is coupled to a plate in a heel section of the sole are electronically and remotely controlled.

19. A pair of powered motorized shoes as claimed in claim 1, wherein the flexible portion is made of a bendable material, and the flexible portion is more than the plates.

20. A pair of powered motorized shoes as claimed in claim 19, wherein at least one of the plates is made of a bendable material that is less bendable-than the flexible portion.

21. A pair of powered motorized shoes to provide, while a user is walking, an increase in a user's walking speed by a translation motion of at least one conveyor housed in soles of each of the shoes, wherein the increase in a user's walking speed is automatically adjusted based upon a user's intended walking speed.

22. A pair of powered motorized shoes as claimed in claim 21, wherein the user's intended walking speed is determined by the user's walking speed without taking into consideration the increase in speed contributed by the translation motion of the at least one conveyor.

23. A pair of powered motorized shoes as claimed in claim 21, further comprising:

at least one sensor housed in each of the soles to sense a movement of the shoes; and a processing unit housed in the soles of each of the shoes, wherein the processing units receive information from the at least one sensor, and wherein, based on information received from the at least one sensor, the processing units send information wirelessly to each other to determine the user's intended walking speed and to control the increase in speed contributed by the translation motion of the at least one conveyor.

24. A pair of powered motorized shoes as claimed in claim 23, wherein the processing unit receives information from the at least one sensor to synchronously change the increase in speed contributed by the translation motion of the at least one conveyor in both of the shoe soles in response to a change in the user's intended walking speed.

25. A pair of powered motorized shoes as claimed in claim 23, wherein the at least one sensor measures a walking speed of the user aided by the shoes, wherein the walking speed of the user aided by the shoes is equal to the sum of the user's intended walking speed plus the increase in speed contributed by the translation motion of the at least one conveyor.

26. A pair of powered motorized shoes as claimed in claim 25, wherein the increase in speed contributed by the translation motion of the at least one conveyor is determined by a parameter X defined as a percentage of the user's intended walking speed.

27. A pair of powered motorized shoes as claimed in claim 26 wherein the parameter X is adjusted electronically and remotely.

28. A pair of powered motorized shoes as claimed in claim 21, further comprising:

at least one sensor attached to a body part of the user to sense a movement of the user's body; and a processing unit housed in the soles of each of the shoes, wherein the processing units receive information from the at least one sensor, and wherein, based on information received from the at least one sensor, the processing units send information wirelessly to each other to determine the user's intended walking speed and to control the increase in speed contributed by the translation motion of the at least one conveyor.

29. A pair of powered motorized shoes as claimed in claim 28, wherein the processing unit receives information from the at least one sensor to synchronously change the increase in speed contributed by the translation motion of the at least one conveyor in both of the shoe soles in response to a change in the user's intended walking speed.

30. A pair of powered motorized as claimed in claim 28, wherein the at least one sensor measures a walking speed of the user aided by the shoes, wherein the walking speed of the user aided by the shoes is equal to the sum of the user's intended walking speed plus the increase in speed contributed by the translation motion of the at least one conveyor.

31. A pair of powered motorized shoes as claimed in claim 30, wherein the increase in speed contributed by the translation motion of the at least one conveyor is determined by a parameter X defined as a percentage of the user's intended walking speed.

32. A pair of powered motorized shoes as claimed in claim 31, wherein the parameter X is adjusted electronically and remotely.

33. A pair of powered motorized shoes comprising at least one conveyor and a processing unit in soles of each of the shoes, wherein the processing unit receives information from at least one motion sensor to deduce a change in a user's intended walking speed that happens during a mid-step and to synchronously change the speed of the conveyors in both of the soles such that a new intended speed of the user aided by the shoes is reached before the step is completed.

34. A pair of powered motorized shoes as claimed in claim 33, wherein the processing unit receives information from the at least one motion sensor in response to a change in the user's intended walking speed that happens during a mid-step and synchronously slows down the speed of the at least one conveyor in both shoes to a stop before the step is completed.

* * * * *